United States Patent [19]

Snader

[11] 3,951,624

[45] Apr. 20, 1976

[54] ELECTROSTATIC PRECIPITATOR

[75] Inventor: Earle Stuart Snader, Pasadena, Md.

[73] Assignee: Koppers Company, Inc., Pittsburgh, Pa.

[22] Filed: Nov. 22, 1974

[21] Appl. No.: 526,201

[52] U.S. Cl. ..... 55/128; 55/136; 55/147; 55/151

[51] Int. Cl.[2] ..... B03C 3/00

[58] Field of Search ..... 55/101, 112, 128, 129, 55/136, 137, 138, 147, 148, 151, 154, 150, 152

[56] References Cited

UNITED STATES PATENTS

| | | | |
|---|---|---|---|
| 2,634,818 | 4/1953 | Wintermute | 55/138 X |
| 3,201,923 | 8/1965 | Gustafsson et al. | 55/112 |
| 3,354,617 | 11/1967 | Hoisington et al. | 55/147 |
| 3,719,031 | 3/1973 | Gelfand | 55/136 |
| 3,733,785 | 5/1973 | Gallaer | 55/129 |
| 3,853,511 | 12/1974 | Huppi | 55/148 X |

FOREIGN PATENTS OR APPLICATIONS

| | | | |
|---|---|---|---|
| 565,152 | 10/1933 | Germany | 55/128 |

*Primary Examiner*—Dennis E. Talbert, Jr.
*Attorney, Agent, or Firm*—Oscar B. Brumback; Boyce C. Dent

[57] ABSTRACT

An electrostatic precipitator for cleaning a gas flowing therethrough comprising a shell having a gas inlet and outlet port and defining a gas chamber therein. Sets of spaced collector electrodes are suspended within the shell, the collector electrodes defining gas passages therebetween. Discharge electrodes are suspended within the gas passages for ionizing particles in the gas for collection by the collector electrodes. Hoppers are suspended below the collector electrodes for collecting the particles dislodged from the collector electrodes, each of the hoppers being suspended beneath at least two of the sets of collector electrodes. A baffle assembly is suspended within each of the hoppers transverse to the gas flow; the baffle assembly includes a rigid portion extending between lower portions of adjacent sets of the collector electrodes and substantially above an outlet end of the hopper and a flexible portion connected to the rigid portion extending therefrom to the outlet end of the hopper for obstructing the flow of gas around the end of the baffle assembly to maintain the gas within the gas passages and to prevent the particles from becoming lodged between the hopper and the baffle assembly upon discharge of the particles from the hopper.

5 Claims, 4 Drawing Figures

FIG. 2
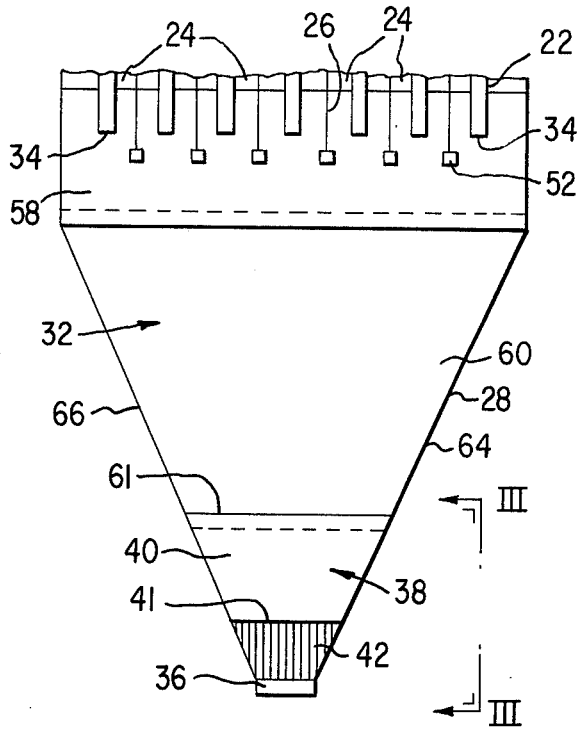
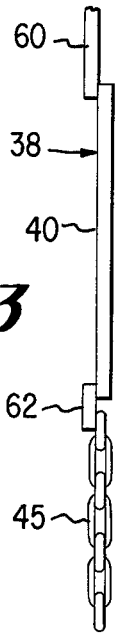
FIG. 3
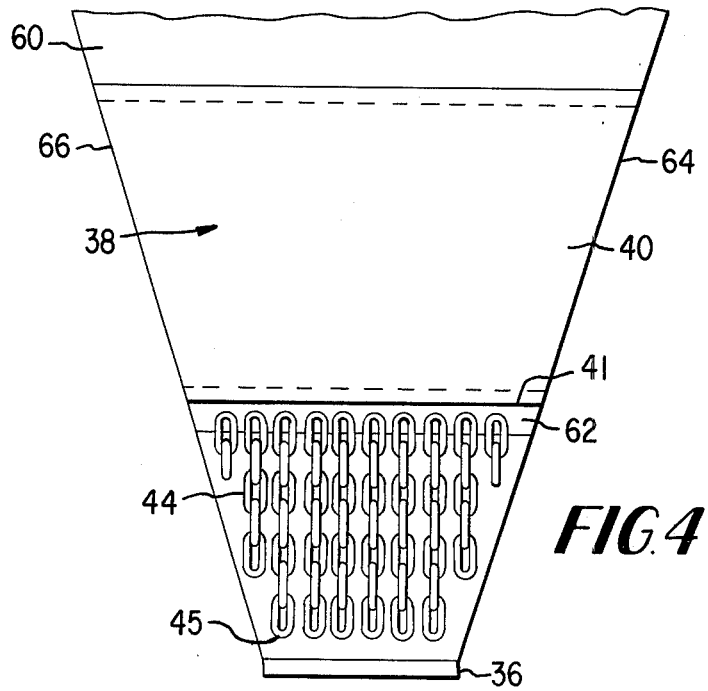
FIG. 4

ELECTROSTATIC PRECIPITATOR

BACKGROUND OF THE INVENTION

1. Field of the Invention

This invention relates generally to gas separation by electrostatic precipitators and more particularly to baffle assemblies used within particle collection hoppers of electrostatic precipitators for reducing re-entrainment of the particles into the gas stream without interfering with emptying of the hoppers.

2. Description of the Prior Art

The removal of particles from a gas stream by electrostatic precipitators is well known in the art. A typical electrostatic precipitator of the plate type which removes particles from a gas flowing therethrough is illustrated in Ragland U.S. Pat. No. 3,425,190. In such electrostatic precipitators, gas flows through an inlet port into the precipitator and through gas passages formed between rows of vertical collecting plates. Some electrostatic precipitators are extremely large and usually include more than one set of collecting plates throughout the precipitator. Each set contains a plurality of spaced collector electrodes. There may be any number of sets of collector electrodes in the precipitator, depending on the size, shape, and degree of precipitation that is desired. Suspended within each of the gas passages in each set of the collector electrodes is a plurality of discharge wire electrodes which are electrically insulated from the shell. As the gas passes through the gas passages between the collector electrodes, the discharge electrodes ionize the particles in the gas which are then attracted to and collected on the vertical collector electrodes. The particles which collect on the collector electrodes are removed therefrom in any conventional manner such as by rapping the electrodes to cause the particles to be dislodged therefrom and fall to the bottom of the precipitator. As shown in the Ragland Patent, the bottom of the precipitator contains a plurality of hopper bins in which the dust particles fall, are collected, and then removed through the bottom of the hopper to the outside of the precipitator.

Ideally, one hopper should be suspended under each set of collector electrodes in order to collect those particles which are removed from the collector electrodes in each set. In this manner, gas flowing beneath the collector electrodes, and thus not subject to precipitation by the discharge electrodes, would only flow below one set of collector electrodes before being forced back up into the gas passages of the remaining sets of collector electrodes by the walls of each hopper. In this way, maximum precipitation of the entire gas is assured and any re-entrainment of the particles in the gas flowing beneath one set of the collector electrodes will be acted upon by the discharge electrodes in the remaining sets of collector electrodes.

Although it is preferred to have only a single hopper below each set of collector electrodes, it has been found that it is impractical to do so because of the high cost of manufacturing and installing an individual hopper under each set of collector electrodes and because of the cost of the machinery and apparatus which is needed for hook up to the bottom of the precipitator to remove the particles for disposal outside the precipitator system. Therefore, alternate means of removing the particles from the electrostatic precipitator has been devised, the most widely used alternate being to have one hopper bin placed under two sets of collector electrodes. This decreases the number of hoppers used in an electrostatic precipitator by one-half. However, the gas stream tending to flow beneath the collector electrodes within each hopper bin by-passes two sets of collector electrodes before it is forced back up into the gas passages. Since the gas stream by-passes two sets of collector electrodes before being forced back up into the gas passages, particle collection is not as efficient as it would be if the gas stream were allowed to flow under only one set of collecting electrodes before being forced back into the gas passages. Therefore, common practice now is to suspend rigid baffles within each hopper between adjacent sets of collector electrodes which extend to a point just above the bottom of the hopper bin. This baffle system obstructs the flow of gas beneath the collector electrodes and forces the gas back up into the gas passages after it flows beneath only one set of collector electrodes.

However, a baffle assembly in each hopper bin between adjacent sets of collector electrodes does have some distinct disadvantages. One disadvantage is that the opening of each hopper bin at the outlet end is extremely small and a rigid baffle extending down to the outlet end effectively cuts in half the space through which the particles must pass for disposal. The particles which fall into the hopper on each side of the baffle assembly tend, in many circumstances, to lodge between the sides of the hopper and the baffle and will not fall through the outlet end. In addition, when particles collect and cool in the hopper, they tend to form a sticky and thick agglomerate which tends to form a bridge between the wall of the hopper and the baffle. If the particles are allowed to cool too long, they become extremely hard and prevent the discharge of the particles from the hopper. In such a situation, the solid bridge of particles between the hopper and the baffle assembly must be broken loose manually by jackhammers or any other conventional means. This, of course, requires the precipitator to be shut down which is undesirable. To prevent particles from lodging between the wall of the hopper and the baffle assembly, and to prevent the bridging action of cooling particles, the baffle assembly may extend to above the end of the hopper. However, it has been found that once the particles have been emptied from the hopper, gas flowing beneath the collector electrodes will also flow down and around the lower end of the baffle assembly and back up the other side; thus, the gas will not be forced back up into the gas passages until it has passed beneath two sets of collector electrodes. Gas flowing around the end of the baffle assembly defeats the purpose of the baffle system.

SUMMARY OF THE INVENTION

Accordingly an object of the present invention is to provide an improved electrostatic precipitator with a particle removal system that will overcome the aforementioned disadvantages and others; thus, the invention provides an electrostatic precipitator with a baffle assembly that will obstruct the flow of gas around the end of the baffle assembly while at the same time preventing the particles from becoming lodged between the baffle assembly and the side of the hopper bin.

This is generally accomplished by providing an electrostatic precipitator with a shell having a gas inlet and outlet port which defines a gas chamber therein; sets of spaced collector electrodes suspended within the shell, the collector electrodes defining gas passages therebetween; discharge electrodes suspended within the gas passages for ionizing particles in the gas for collection on the collector electrodes; hoppers suspended below the collector electrodes for collection of the particles dislodged from the collector electrodes, each of the hoppers being suspended beneath at least two sets of collector electrodes; and baffle means suspended within each of the hoppers transverse to the gas flow, each of the baffle means having; a rigid portion extending between lower portions of adjacent sets of the collector electrodes and substantially above an outlet end of the hopper; and a flexible portion connected to the rigid portion and extending to the outlet end of the hopper for obstructing the gas flow around the end of the baffle means to maintain the gas within the gas passages and to prevent the particles from becoming lodged between the hopper and the baffle means upon discharge of the particles from the hopper.

The above and further objects and novel features of the invention will appear more fully from the following detailed description when the same is read in connection with the accompanying drawings; it is to be expressly understood, however, that the drawings are not intended as definition of the invention, but are for the purpose of illustration only.

BRIEF DESCRIPTION OF THE DRAWINGS

In the drawings wherein like parts are marked alike:

FIG. 2 is a partial end view of the electrostatic precipitator taken along the lines II—II of FIG. 1 showing the gas passages between adjacent collector electrodes and the baffle assembly suspended within the hopper;

FIG. 3 is an enlarged view of the flexible portion of the baffle assembly taken along the lines III—III of FIG. 2 showing the support plate and the flexible section of link chain; and FIG. 4 is a side view of FIG. 3 showing the support plate and plurality of link chains suspended therefrom.

DESCRIPTION OF THE PREFERRED EMBODIMENT

Figure 1:
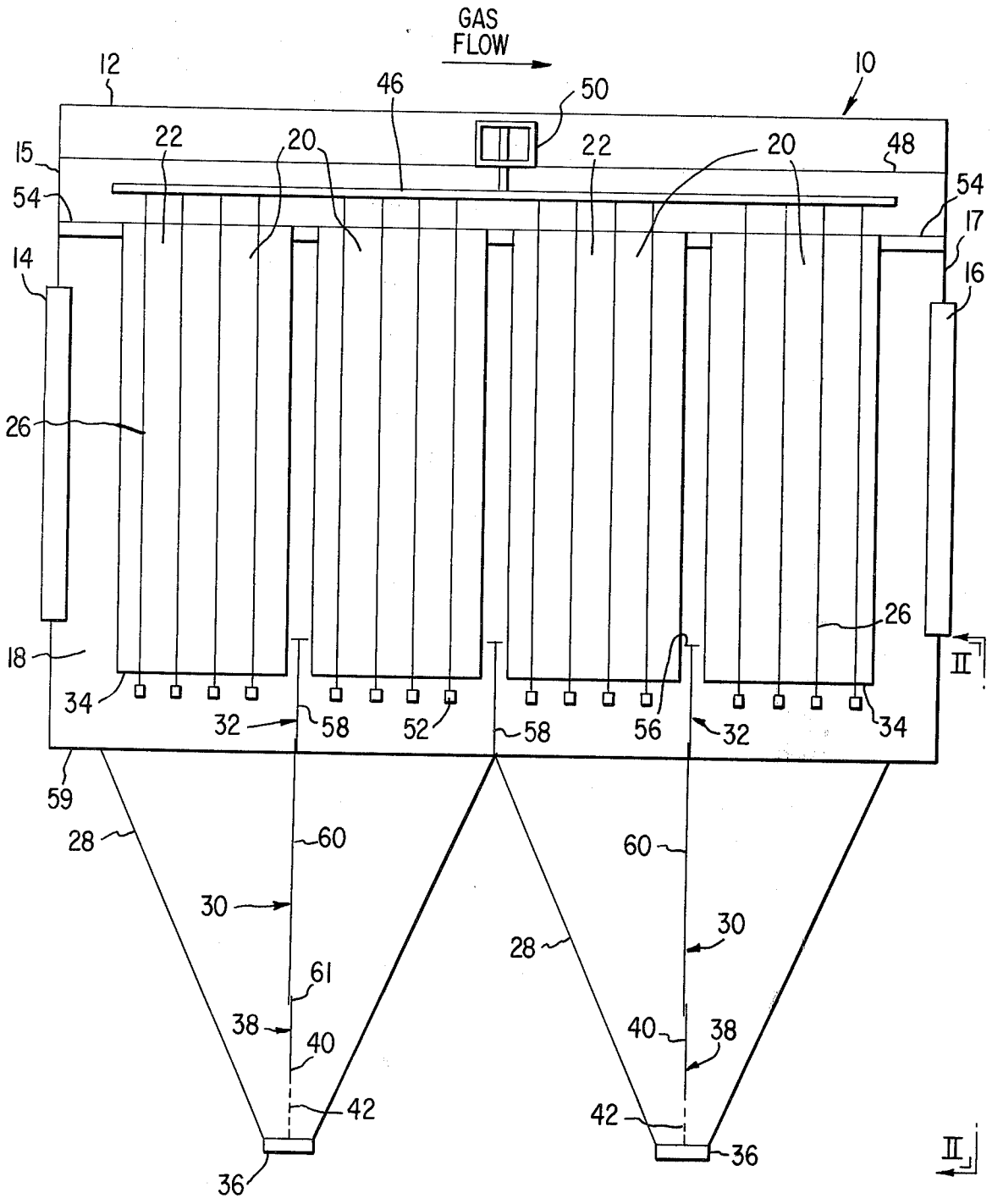
FIG. 1 is a schematic illustration in side elevation of an electrostatic precipitator of the present invention.

Referring to FIG. 1, an electrostatic precipitator, denoted generally by numeral 10, generally comprises a shell 12 having a gas inlet port 14 and outlet port 16 and defining a gas chamber 18 therein. Sets 20 of spaced collector electrodes 22 are suspended within shell 12, the collector electrodes 22 defining gas passages 24 (FIG. 2) therebetween. Discharge electrodes 26 are suspended within gas passages 24 for ionizing particles in the gas for collection by collector electrodes 22 in the conventional manner. Hoppers 28 are suspended below collector electrodes 22 for collection of particles dislodged from the collector electrodes 22, each of the hoppers 28 being suspended beneath at least two of the sets 20 of collector electrodes 22. Baffle means, denoted generally by numeral 30, are suspended within each hopper 28 transverse to the gas flow as illustrated in FIG. 1. Baffle means 30 comprises a rigid portion, denoted generally by numeral 32, extending between lower portions 34 of adjacent sets 20 of collector electrodes 22 in substantially vertical alignment with an outlet end 36 of hopper 28. A flexible portion, denoted generally by numeral 38, is connected to rigid portion 32 and extends downward therefrom to outlet end 36 of hopper 28. Baffle means 30 maintains the gas within gas passages 24 by obstructing the gas flow around the end of baffle means 30 and prevents the particles from becoming lodged between hopper 28 and baffle means 30 upon discharge of the particles from hopper 28.

More specifically, precipitator 10 comprises a shell 12 which is preferably rectangular in shape. Shell 12 includes a gas inlet port 14 on one end and a gas outlet port 16 on the other. Gas inlet port 14 is connected to conventional duct work (not shown) which in turn is connected to the apparatus (not shown) that produces a particle laden gas that must be cleaned. Outlet port 16 is connected to conventional duct work (not shown) which in turn is connected to a gas stack (not shown) or other conventional apparatus for conveying clean gas to the atmosphere. The space defined by shell 12 between inlet port 14 and outlet port 16 comprises a gas chamber 18.

Sets 20 of collector electrodes 22 are suspended within gas chamber 18. Collector electrodes 22 in each set 20 are spaced transverse to the gas flow through precipitator 10 thus forming gas passages 24 between adjacent collector electrodes 22 as illustrated in FIG. 2. Each set 20 of collector electrodes 22 is spaced within gas chamber 18 in the direction of the gas flow as illustrated in FIG. 1. Thus, there are continuous gas passages 24 that run the entire length of precipitator 10.

Collector electrodes 22 are suspended within gas chamber 18 in any conventional manner such as, for example, securing them to a support beam 54 secured to side walls 15 and 17 of precipitator 10. Suspended within gas passages 24, between adjacent collector electrodes 22, is a plurality of discharge electrodes 26. Discharge electrodes 26 are preferably of the conventional wire type; however, any type of discharge electrode 26 may be used. Discharge electrodes 26 are at a higher voltage potential and different polarity than collector electrodes 22 and must be insulated from shell 12 to which collector electrodes 22 are attached and suspended. The discharge electrodes 22 are suspended within gas chamber 18 in any conventional manner such as, for example, by a support plate 48 spaced above the top of collector electrodes 22 and secured to shell 12 of precipitator 10. A discharge electrode support grid 46 is suspended from plate 48 by connecting it to an insulator 50 mounted and secured to the top of plate 48. Discharge electrode support grid 46 is thus insulated from support plate 48 and shell 12. Each discharge electrode 26 is attached to and suspended from discharge electrode support grid 46 so that it is suspended within gas passages 24. A weight 52 may be attached to the bottom of each discharge electrode 26 to hold it straight and to reduce oscillation due to the electrical field surrounding the wires when they are energized.

Referring again to FIG. 1, below gas chamber 18 of precipitator 10 is a plurality of hoppers 28. Preferably, hoppers 28 are attached to the bottom of precipitator 10 so that each hopper 28 is directly below two adjacent sets 20 of collector electrodes 22. To obstruct the flow of gas below lower portion 34 of collector electrodes 22, a baffle means 30 is suspended between adjacent sets 20 of collector electrodes 22 within each hopper 28. Baffle means 30 extends from a point above lower portion 34 of collector electrode 22 to a point just above outlet end 36 of each hopper 28.

Baffle means 30 includes two sections; a rigid portion 32 and a flexible portion 38. Rigid portion 32 includes a support beam 56 (FIG. 1) which extends the width of precipitator 10 transverse to the gas flow and is connected to the sides. (not shown) of shell 12 of precipitator 10. Support beam 56 is positioned above lower portions 34 of collector electrodes 22 and between adjacent sets 20 of collector electrodes 22. A rigid first plate 58 (FIGS. 1 and 2) is connected to support beam 56 and extends the width of precipitator 10 transverse to the direction of gas flow and extends downward from support beam 56 to the bottom 59 of precipitator 10. A second rigid plate 60 is secured to the bottom of each first rigid plate 58 suspended above each hopper 28 and extends into hopper 28 to a point 61 substantially above outlet end 36 of hopper 28. Second rigid plate 60 is shaped the same as the shape of sides 64 and 66 of hopper 28 as best shown in FIG. 2. Second rigid plate 60 is secured to the sides 64 and 66 of hopper 28, such as by welding, to produce a gas tight seal between adjacent sides of hopper 28.

Referring now to FIGS. 2, 3, and 4, the second part of baffle means 30 comprises a flexible portion 38. Flexible portion 38 includes a support plate 40 and a flexible section 42 (FIG. 2). Support plate 40 is secured to the lower end of rigid plate 60, such as by welding, and is shaped to conform to the shape of side walls 64 and 66 of hopper 28 and is secured to sides 64 and 66 of hopper 28 such as by welding. Support plate 40 extends down into hopper 28 to a point 41 (FIGS. 2 and 4) above outlet end 36 of hopper 28. Section 42 (FIG. 2) is preferably flexible and is connected to the bottom of support plate 40 and extends to outlet end 36 of hopper 28 for preventing gas from flowing around the end of flexible portion 38 while at the same time allowing the particles to pass through outlet end 36 by moving flexible section 42 out of the way. Preferably, flexible section 42 includes a support plate 62 which is secured to the bottom end of support plate 40 and is shaped the same as sides 64 and 66 of hopper 28 and is secured to sides 64 and 66 of hopper 28 such as by welding. A plurality of link chains 44 are secured, such as by welding, at one end to support plate 62 transverse to the direction of gas flow, and hang down to outlet end 36 of hopper 28. As shown in FIG. 4, link chains 44 are of various lengths to conform the shape of flexible portion 38 to the sides 64 and 66 of hopper 28. Preferably, the chain link portion of baffle 32 is about one third its total height. This length of link chains 45 will insure the maximum obstruction to the flow of gas around the bottom of second support plate 62 and at the same time will allow sufficient space between support plate 62 and outlet end 36 for the particles to pass through outlet 36 by pushing link chains 44 to one side. It should be understood that the sets of electrodes 20 are usually rapped individually so that particles fall first on one side of baffle 30 and then on the other.

In operation, a particle laden gas flows through the conventional duct work (not shown) and through inlet port 14 into gas chamber 18. The gas then flows in gas passages 24 between adjacent collector electrodes 22 in each set 20, in the direction of gas flow as shown in FIG. 1. The particle laden gas also flows below the lower portion 34 of collector electrodes 22 and into hoppers 28. However, the gas is obstructed from flowing beneath collector electrodes 22 by baffle means 30. Baffle means 30 forces the particle laden gas back up into gas passages 24 between collector electrodes 22. The gas will also flow downward to the bottom of hopper 28. However, due to the flexible second portion 38 of baffle means 30, the gas is prevented from flowing around support plate 62 by the chains 44 which make up flexible portion 38. Initially, a small amount of particle laden gas will flow through the openings in the links in chains 44 and the spaces between adjacent chains 44 at the bottom of hopper 28. However, once the particles begin to collect within hopper 28, the particles will also collect on the chains 44 and will tend to close up the holes in chains 44 and between chains 44. The particles thus help to prevent the gas from flowing through the chains and around the bottom of the chains. This increases the efficiency of the precipitator system and in addition will force the particle laden gas that flows to the bottom of hopper 28 back up into gas passages 24.

The gas flows through the gas passages 24 between collector electrodes 22. The discharge electrodes 26 are energized and form an electrical field between collector electrodes 22 and discharge electrodes 26. This electrical field around discharge electrodes 26 ionizes the particles within the gas flowing therethrough. These ionized particles are then collected on the surface of collector electrodes 22. The particles collected on collector electrodes 22 are removed in any conventional manner such as, for example, by a conventional rapper system (not shown) within precipitator 10 which strikes the collector electrodes 22 at specified intervals to dislodge the particles from collector electrodes 22 and cause them to fall into hopper 28.

The particles are collected within hopper 28 until it is desired to dispose of the particles outside the precipitator system. At this time, the outlet end 36 of hopper 28 is opened and the dust particles are allowed to fall through outlet end 36 for disposal in the conventional manner. Since the particles are allowed to collect within hopper 28 for a certain length of time prior to being disposed of, clumps of particles may form or the particles may cool and become sticky and lodge between the sides of hopper 28 and baffle 30. However, since the end of baffle 30 is a flexible portion 38, which comprises a plurality of chains 44, the particles which are being emptied through outlet 36 and the clumps of particles will push chains 44 out of the way so that the particles will fall through outlet end 36 and, in addition, chains 44 are high enough above outlet end 36 so that any bridging action which is formed by the particles when they cool will bridge against the sides of hopper 28 and chains 44. Thus, when hopper 28 is emptied of the particles through outlet end 36, the bridge will force chains 44 outward so that the bridge collapses and the clumps fall throughoutlet end 36. Once the particles are removed from hopper 28, outlet end 36 is closed and the particles are allowed to collect once again in hopper 28 for subsequent disposal.

The gas continues flowing through gas passages 24 between collector electrodes 22. The gas flows through the entire length of precipitator 10 through gas passages 24 and is cleaned by discharge electrodes 26 and collector electrodes 22. The clean gas then flows through outlet port 16 of precipitator 10 and to the atmosphere through conventional duct work (not shown) from outlet port 16 and subsequently to a gas stack which releases the clean gas to the atmosphere.

The foregoing has presented a novel electrostatic precipitator system. The problem of maintaining the particle laden gas within the gas passages between collector electrodes has been eliminated by maintaining a baffle system which is partially rigid and partially flexible between adjacent sets of the collector electrodes and the bottom of the hopper which is positioned below two sets of the collector electrodes. This baffle system forces the gas back up into the gas passages and obstructs the flow of gas around the bottom of the baffle system thereby preventing the gas from by-passing more than one set of collector electrodes. The problem of having large particles lodge between the hopper sides and the baffle means, and having cold particles bridge between the sides of the hopper and the baffle means which prevents the particles from falling through the outlet end of the hopper, has been eliminated by the use of a flexible portion at the bottom of the baffle. The flexible portion is preferably made of link chain and is flexible enough so that large particles will push chains to one side and out of the way so that the particles can fall through the hopper for disposal.

Accordingly, the invention having been described in its best embodiment and mode of operation, that which is desired to be claimed by Letters Patent is:

1. An electrostatic precipitator for cleaning a gas flowing therethrough comprising in combination:

shell means having a gas inlet port and a gas outlet port and defining a gas chamber therein;

sets of spaced collector electrode means suspended within said shell means said collector electrode means defining gas passages therebetween;

discharge electrode means suspended within said gas passages for ionizing particles in said gas for collection on said collector electrode means;

hopper means suspended below said collector electrode means for collecting particles dislodged from said collector electrode means, each of said hoppers being suspended beneath at least two of said sets of collector electrode means; and baffle means suspended within each of said hoppers transverse to said gas flow, said baffle means having:

a rigid portion extending between and below lower portions of adjacent sets of said collector electrode means and terminating substantially above an outlet end of said hopper means; and a flexible portion connected to said rigid portion and extending therefrom to said outlet end of said hopper means for obstructing the flow of said gas in said hopper means to maintain said gas within said gas passages and to prevent said particles from becoming lodged between said hopper means and said rigid portion upon discharge of said particles from said hopper means.

2. The electrostatic precipitator of claim 1 wherein said flexible portion is substantially one third the height of said baffle means.

3. The electrostatic precipitator of claim 1 wherein said flexible portion includes:

support plate means connected to said rigid portion; and a plurality of flexible members connected to said support plate means and extending therefrom to said outlet end of said hopper means for obstructing the flow of gas in said hopper means and allowing said particles to pass out of said outlet end through said flexible members.

4. The electrostatic precipitator of claim 3 wherein said flexible members comprise a plurality of chains connected to and spaced along said support plate means.

5. The electrostatic precipitator of claim 4 wherein said chains vary in length to conform the shape of said flexible portion to the shape of said hopper means.

* * * * *